US006041685A

United States Patent [19]

Dick

[11] Patent Number: 6,041,685

[45] Date of Patent: Mar. 28, 2000

[54] IMPACT MICROMETER

[75] Inventor: Raymond E. Dick, Overland Park, Kans.

[73] Assignee: Preco Industries, Inc., Lenexa, Kans.

[21] Appl. No.: 09/103,091

[22] Filed: Jun. 23, 1998

[51] Int. Cl.[7] ..... B26B 5/08; B30B 15/00

[52] U.S. Cl. ..... 83/530; 83/527; 100/257; 72/446

[58] Field of Search ..... 83/530, 529, 527; 100/257, 43, 53; 72/446, 31.01

[56] References Cited

U.S. PATENT DOCUMENTS

| | | | |
|---|---|---|---|
| 3,333,447 | 8/1967 | Alspaugh | 83/529 |
| 3,400,625 | 9/1968 | Wrona | 83/529 |
| 3,450,037 | 6/1969 | Lickliter et al. | 83/529 X |
| 3,635,102 | 1/1972 | Skeen | 74/600 |
| 4,024,807 | 5/1977 | Karsen | 83/529 X |
| 4,790,173 | 12/1988 | Boutcher, Jr. | 83/530 X |
| 5,113,736 | 5/1992 | Meyerle | 83/530 X |
| 5,245,904 | 9/1993 | Meyerle | 83/529 |
| 5,285,722 | 2/1994 | Schockman | 100/257 X |
| 5,349,902 | 9/1994 | Daniel et al. | 83/530 X |
| 5,609,099 | 3/1997 | Burns et al. | 100/257 |
| 5,644,979 | 7/1997 | Raney | 100/35 |
| 5,682,813 | 11/1997 | Brewer et al. | 100/257 |

*Primary Examiner*—Rinaldi I. Rada
*Assistant Examiner*—T. Anthony Vaughn
*Attorney, Agent, or Firm*—Hovey, Williams, Timmons & Collins

[57] ABSTRACT

Adjustable apparatus (20, 20*a*) is provided, preferably in the form of an impact micrometer, which includes first and second interfitted bodies (22, 24, 22*a*, 24*a*) cooperatively defining therebetween an enclosed, constant volume internal fluid chamber (58, 58*a*). An adjuster (26,26*a*) is also provided which is connected to one of the first and second bodies (22, 24, 22*a*, 24*a*) and has an element (68, 68*a*) movable within the chamber (58, 58*a*). Preferably, the adjuster (26, 26*a*) is threadably coupled with the first body (22, 22*a*) through fine micrometer threading (36, 62, 36*a*, 62*a*). In use, the apparatus (20,20*a* be adjusted through rotation of the adjuster (26,26*a*) causing corresponding movement of the element (68, 68*a*) within the chamber (58, 58*a*); this in turn results in displacement of the fluid (59, 59*a*) to change the shape but not the volume of the chamber (58, 58*a*) and consequent movement of the first body (22, 22*a*) because of the incompressible nature of the fluid (59, 59*a*). When an impact load is experienced by the apparatus (20, 20*a*), such load is transmitted via an internal transmitting surface (44, 44*a*) and through the fluid (59, 59*a*). A substantially reduced portion of such load is transmitted to the threading (36, 62, 36*a*, 62*a*) because of the reduced load-transmitting surface area (72, 72*a*) of the element (68, 68*a*), as compared with the load-bearing surface presented by the second body (24, 24*a*).

14 Claims, 4 Drawing Sheets

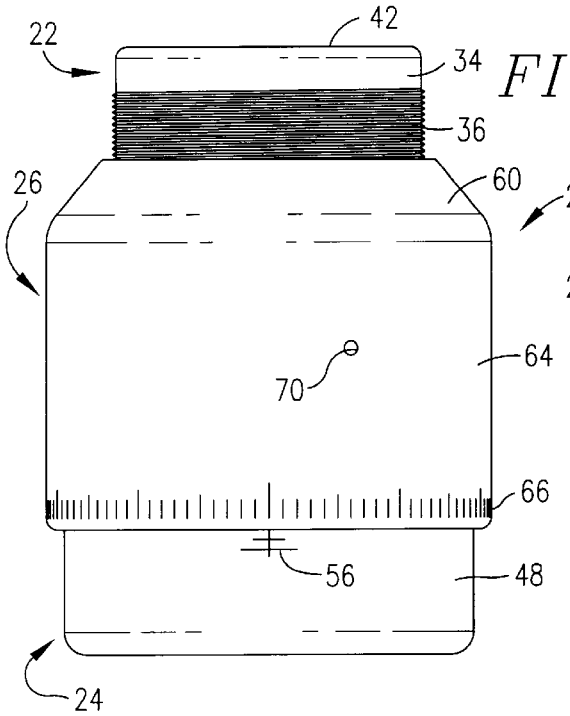
FIG. 1
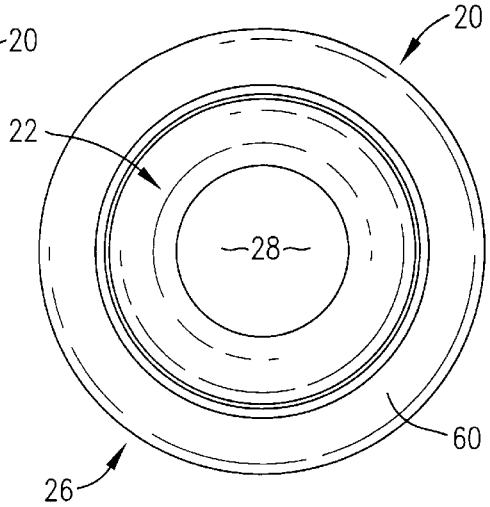
FIG. 2.
FIG. 3.
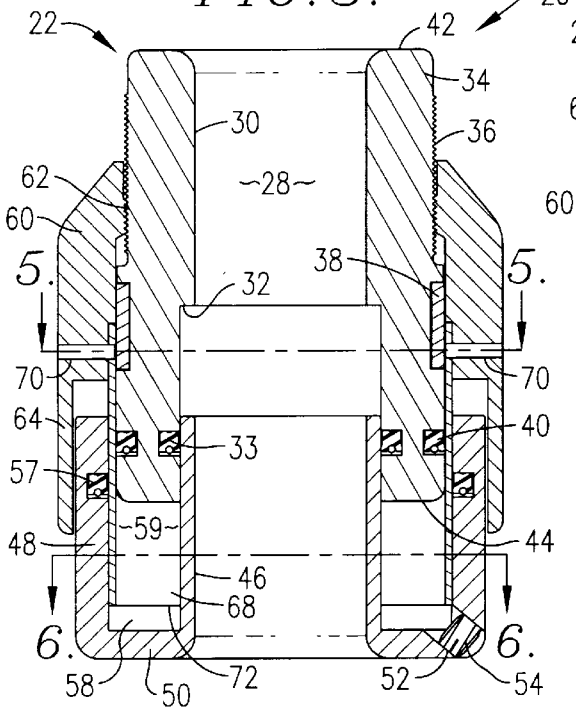
FIG. 4.
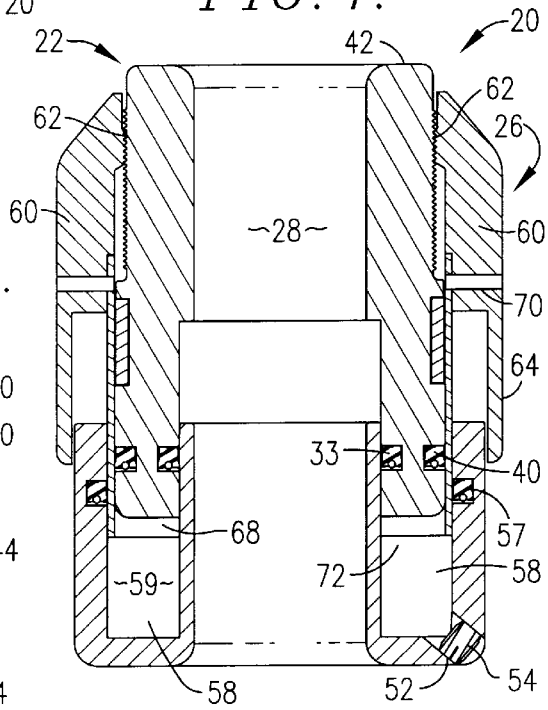

FIG. 5.
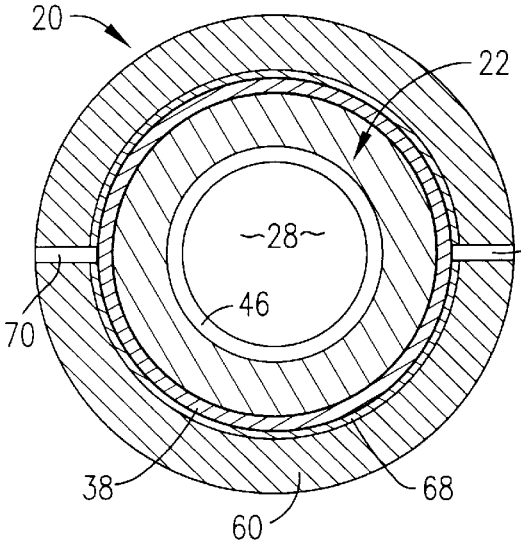
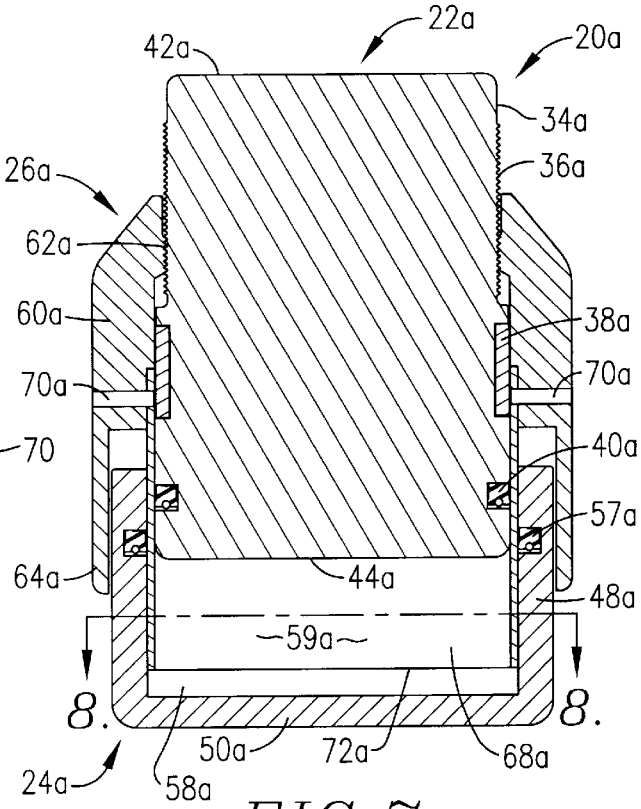
FIG. 7
FIG. 6.
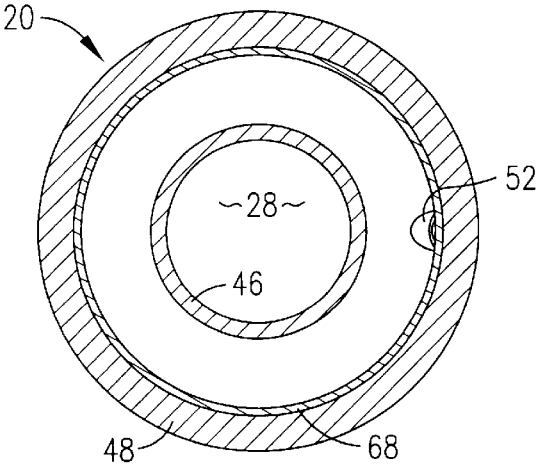
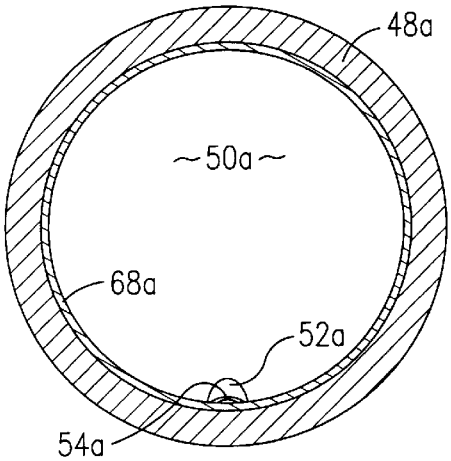
FIG. 8.

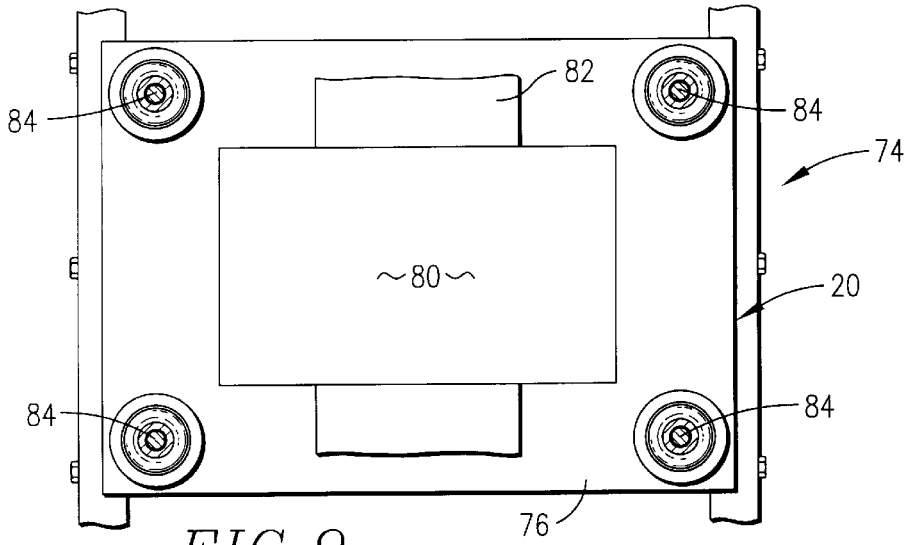
FIG. 9.
FIG. 10.
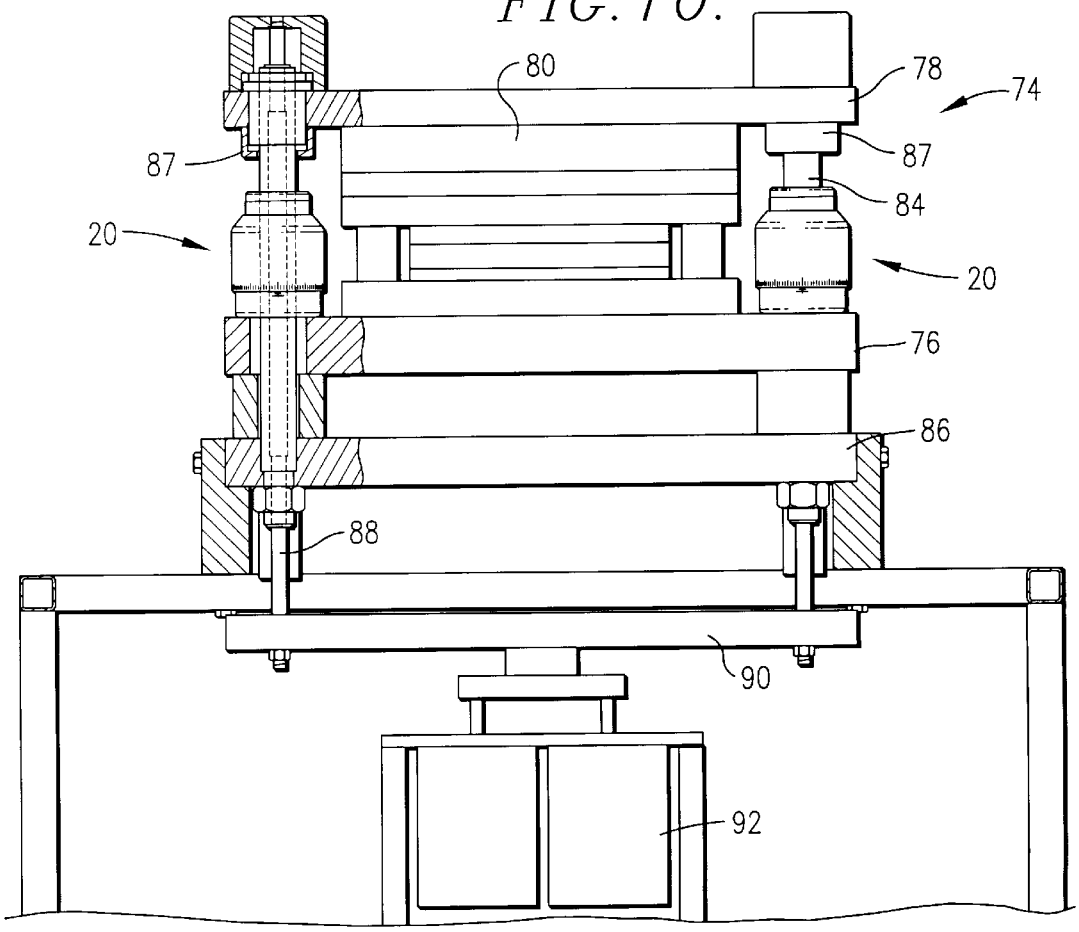

IMPACT MICROMETER

BACKGROUND OF THE INVENTION

1. Field of the Invention

The present invention is broadly concerned with improved adjustment apparatus, preferably in the form of an impact micrometer designed for limiting the stroke lengths of die cutting presses or other forming machines. More particularly, the invention pertains to apparatus of this type which are especially constructed to absorb impact loads without damage to the micrometer threading thereof. This is accomplished by reducing the load area of the adjustment mechanism relative to the total load-bearing area of the micrometer using a sealed fluid-filled chamber to transfer loads to the adjustment mechanism.

2. Description of Prior Art

In the operation of conventional die cutting presses, a die set is positioned between a movable ram and a fixed bolster plate, and the ram is repeatedly moved toward the fixed bolster to perform cutting operations on workpieces. In order to properly die cut the workpiece and prevent damage to the die set, it is necessary to closely control the stroke length of the ram. That is, if the stroke length is too long, the resultant die cut may be too deep, and/or the die carried by the die set may be damaged or ruined. Likewise, if the stroke length is too short, the workpiece will be insufficiently cut. In addition to the need for controlling ram stroke length, it is often necessary to adjust the stroke length for different types of workpieces or operating conditions.

It has been known in the past to use stops in die cutting presses for controlling stroke length. If adjustability of the stops is not a concern, then a variety of conventional stop configurations can be used. However, if fine micrometer-scale adjustment of stroke length is required, a severe problem is presented. On the one hand, the stops need to be robust enough to withstand millions of impact cycles, and on the other need to be finely adjustable (0.0001" resolution), implying the need for fine micrometer threading as a part of the adjustment mechanism. If typical fine threaded micrometers are employed as a part of the stops, the rather severe and repeated impact loads developed during die cutting operations can very quickly destroy the micrometer threading. This results because virtually all of the impact loads are transmitted to the threading in such conventional micrometer designs.

SUMMARY OF THE INVENTION

The present invention overcomes the problems outlined above and provides an adjustable apparatus, preferably in the form of an impact micrometer, which has a unique design allowing fine (0.0001" resolution) adjustment while nevertheless substantially reducing the impact loads experienced by the micrometer threading.

Broadly speaking, the adjustable apparatus of the invention includes first and second interfitted bodies cooperatively defining an enclosed, internal, constant volume chamber holding a substantially incompressible fluid such as hydraulic oil. The first body presents an external loading surface oriented for receiving an applied load during use of the apparatus, and an internal load-transmitting surface in contact with the fluid. The second body also has a load-bearing surface area in contact with the fluid. An adjuster is connected to one of the first and second bodies and has an element presenting an internal load-transmitting surface area. The element is movable within the chamber in response to adjuster movement in order to cause relative movement between the first and second bodies, i.e., the effective shape of the chamber is altered while the volume thereof remains constant. In order to minimize transmitted loads to the connection between the adjuster and the coupled first or second body, the element load-transmitting surface area is less than the load-bearing surface area of the second body. This arrangement permits a load reduction factor of at least 8 (and preferably up to 35), i.e., for a load reduction factor of 8, ⅛ of the load is carried by the adjuster body connection, and ⅞ of the load is carried by the first body.

In preferred forms, the adjuster is a rotatable member threadably coupled to the first body, with the adjuster element attached to the rotatable member for movement therewith. In this manner, the first body is slidable relative to the second body upon rotation of the adjuster. The first and second bodies, as well as the internal chamber and adjuster element, can be of annular configuration, and this is the preferred configuration when the devices are used with die cutting presses. Alternately, the first body may be cylindrical whereas the second body is cup-shaped to receive the first body.

BRIEF DESCRIPTION OF THE DRAWINGS

FIG. 1 is a side elevational view of an impact micrometer according to the present invention;

FIG. 2 is a plan view of the impact micrometer of FIG. 1;

FIG. 3 is a vertical sectional view of the impact micrometer of FIG. 1 illustrating an extended position of the device;

FIG. 4 is a vertical sectional view of the impact micrometer of FIG. 1 illustrating a retracted position of the device;

FIG. 5 is a horizontal sectional view of the impact micrometer of FIG. 1 taken along line 5—5 in FIG. 3;

FIG. 6 is a horizontal sectional view of the impact micrometer of FIG. 1 taken along line 6—6 in FIG. 3;

FIG. 7 is a vertical sectional view of an alternate embodiment of an impact micrometer according to the present invention;

FIG. 8 is a horizontal sectional view of the impact micrometer of FIG. 7 taken along line 8—8 in FIG. 7;

FIG. 9 is a top view in partial section of a die cutting press using the impact micrometers of the invention as adjustable ram stops;

FIG. 10 is a front view, in partial cross-section, of the press of FIG. 9.

DETAILED DESCRIPTION OF THE PREFERRED EMBODIMENTS

Figure 11:
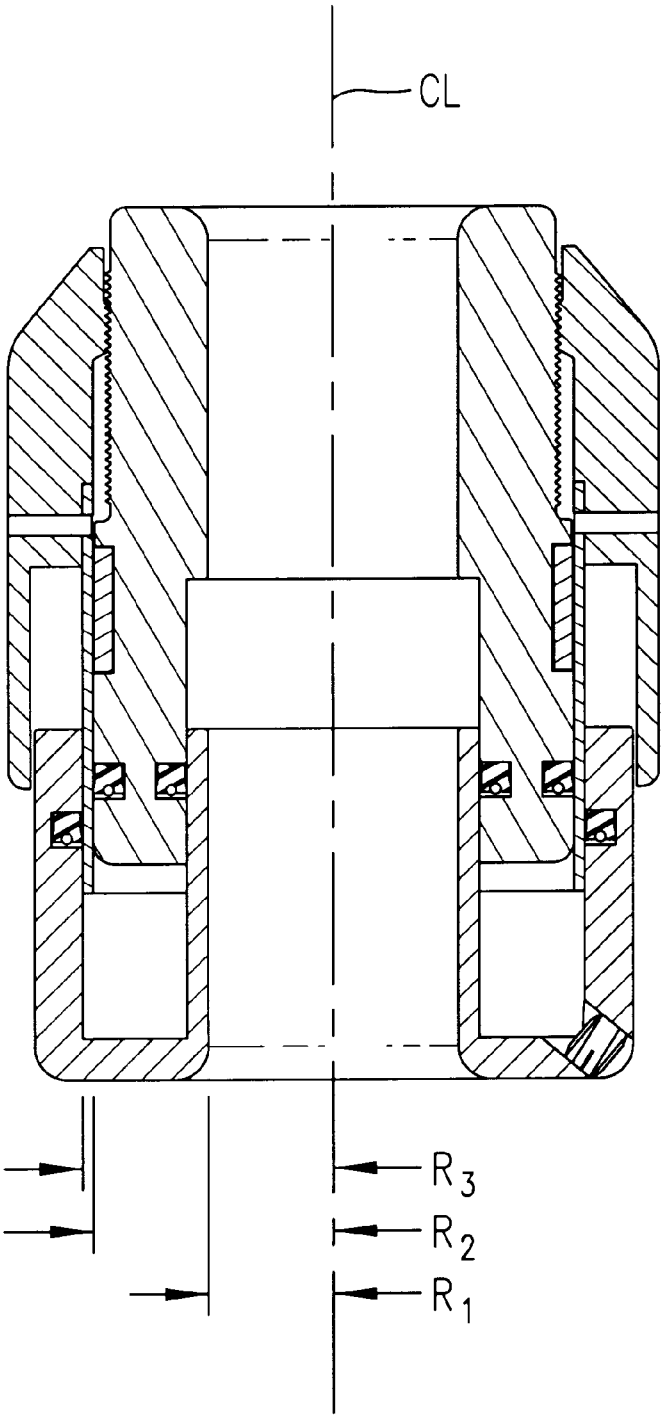
FIG. 11 is a view similar to FIG. 9, but illustrating certain dimensional relationships in the apparatus.

Turning now to the drawings, and particularly FIGS. 1–4, adjustment apparatus 20 of the invention is illustrated, in the form of an impact micrometer. Broadly speaking, the apparatus 20 includes first and second telescopically interfitted bodies 22, 24 together with an adjuster 26.

The first body 22 is of elongated, pin-like tubular configuration, presenting a central passageway 28 therethrough. As best seen in FIGS. 3 and 4, the inner surface 30 of the body 22 is of stepped configuration, presenting a shoulder 32 and a circumferential internal seal 33 adjacent the lower end thereof. The outer surface 34 of the body 22 has fine threading 36 in the upper portion thereof, and carries a bearing plate 38 and outboard circumferential seal 40 below the threading 36. The first body 22 presents an uppermost annular loading surface 42 as well as an opposed, lowermost force-transmitting surface 44 of known area.

The second body 24 is of cup-shaped annular configuration, having spaced apart inner and outer annular walls 46, 48 and bottom wall 50. As best seen in FIGS. 3–4, bottom wall 50 has a threaded oil filling opening 52 therethrough, which is normally plugged by screw 54. In addition, the outer surface of wall 48 has a vertical scale 56 described thereon. Finally, the inner surface of wall 48 is equipped with a circumferential seal 57

As illustrated in FIGS. 3–4, the first body 22 is telescopically interfitted within the second body 24 so as to define an enclosed, annular internal chamber 58 therebetween. The chamber 58 is designed to be of constant volume (although the effective shape thereof will change) and be completely filled with a substantially incompressible fluid such as hydraulic oil 59.

The adjuster 26 is also of annular design and includes a main body 60 terminating in a head having threads 62 which mate with threads 36 of body 22. An external sleeve-type annular extension 64 depends from body 60 as shown and is oriented to closely overlie the outer surface of wall 48 of second body 24. The extension 64 carries a circumferential scale 66 (FIG. 1) which is correlated with scale 56 for fine adjustment purposes. It will be observed that the adjuster 26 includes a relatively thin, metallic annular element 68 which extends into the chamber 58. The element 68 is coupled to main body 60 of the adjuster by means of roll pins 70.

As illustrated in FIGS. 3 and 4, the element 68 presents a lowermost annular internal load-transmitting surface area 72 oriented substantially transverse to the longitudinal axis of the apparatus 20, i.e., it is generally parallel with the surface 44.

FIG. 11 depicts certain important dimensional relationships in the apparatus 20, where $R_1$, $R_2$ and $R_3$ are distances measured from the centerline CL of the device as shown. It can be demonstrated that the total load-bearing area of the apparatus 20 is calculated as $\pi(R_3^2-R_1^2)$ whereas the load-bearing area presented by the element 58 of the adjuster 26 is calculated as $\pi(R_3^2-R_2^2)$. The load reduction factor can then be determined to be $(R_3^2-R_1^2)/(R_3^2-R_2^2)$. Of course analogous calculations can be made for any other desired size and shape of adjustment apparatus.

FIGS. 7–8 depict a second embodiment in accordance with the invention, which is very similar to that of FIGS. 1–6. In this instance however, the apparatus 20*a* includes a substantially cylindrical first body 22*a*, a cup-shaped lower second body 24*a*, and rotatable adjuster 26*a*.

In particular, the body 22*a* has an outer surface 34*a* provided with fine threading 36*a*, and carries a bearing plate 38*a* and circumferential seal 40*a*. The body 22*a* moreover presents an uppermost circular loading surface 42*a* and a circular lower force-transmitting surface area 44*a*.

The second body 24*a* is cup-shaped, presenting an upstanding sidewall 48*a* and circular bottom wall 50*a*, the latter having a filling opening 52*a* normally sealed via screw 54*a*. The inner surface of wall 48*a* has a circumferential seal 57*a*. As shown, the first body 22*a* is telescopically interfitted within the body 24*a* in order to define therebetween a constant volume cylindrical chamber 58*a* which is filled with an incompressible fluid 59*a*.

The adjuster 26*a* includes a main body 60*a* having threading 62*a* thereon which mates with threading 36*a*. The extension 64*a* depends from main body 60*a* and overlies the outer surface of wall 48*a*. Although not shown, it will be understood that scales identical with the scales 56, 66 of the first embodiment are provided on the second body 26*a* and extension 64*a*. The adjuster 26*a* also carries a thin, annular, metallic element 68*a* which is coupled thereto via roll pins 70*a*. The element 68*a* presents a lowermost transverse secondary load-transmitting surface area 72*a*.

The operation of each of the above described embodiments is identical in principle. Accordingly, such operation will be described with reference to the embodiment of FIGS. 1–6, with the understanding that the explanation applies equally to the second embodiment.

Once the apparatus 20 is in place, it is a simple matter to adjust the effective height thereof. That is, the rotatable adjuster 26 is turned so that the adjuster and the coupled element 68 move relative to the second body 24. When this occurs, and depending upon the direction of rotation of the adjuster 26, the element 68 is moved into or out of the chamber 58. This in turn effects a corresponding displacement of the fluid 59 within the chamber 58 (changing the shape but not the volume of the chamber) so that the first body 22 (and thus the adjuster 26 coupled thereto) is moved because of the incompressibility of the fluid 59. For example, FIG. 3 illustrates a configuration wherein the apparatus 20 is adjusted for greater height; in this configuration, the element 68 is moved relatively deeply within the chamber 58, and fluid 59 elevates the first body 22 relative to the second body 24. FIG. 4 shows an alternate orientation where the apparatus 20 is adjusted for a lower overall height. In this situation, the element 68 is substantially withdrawn from the chamber 58, thereby causing the body 22 to move downwardly.

When the apparatus 20 is adjusted to a desired height as described, and an impact or other load is applied to the surface 42, such load is transmitted through the surface 44 and fluid 59 to the cup-shaped second body 24. Such forces are largely borne by the second body 24, but a portion thereof is absorbed by secondary surface 72 and are ultimately borne by the mated threading 36, 62. However, owing to the substantial difference between the surface area 72 and that of the bottom of body 24 it will be appreciated that the amount of force actually experienced by the micrometer threading is substantially reduced. Indeed, depending upon the chosen sizes of the load-bearing surfaces, the reduction can easily be a factor of eight times an up to 35 times or more. It will be appreciated that greater transmitted force reductions can be achieved with the embodiment of FIGS. 7–8, as compared with the first embodiment. Also, the use of the fluid-filled chamber 52 provides some dampening of the impact load without significant deformation, owing to the fluid's very limited compressibility.

Of course, during adjustment and impact loading of the device 20, the seals 34, 40 and 57 serve to seal the chamber 58 and prevent leaking of oil 59 therefrom. If from time to time oil is lost, it can be replaced through the fill opening 52.

Attention is next directed to FIGS. 9–10 which illustrate a die cutting press 74 equipped with adjustment apparatus (impact micrometers) 20 in accordance with the invention. The press 74 is essentially conventional except for the micrometers 20 and includes a rigid bolster 76 and an adjacent ram 78. A die set 80 is situated between the bolster 76 and ram 78 and is adapted to receive a workpiece 82 therein for die cutting purposes. The ram is supported by a total of four corner-mounted telescopic post assemblies 84 which are coupled to the ram by conventional means and extend downwardly through bolster 76 for connection with a reference plate 86. As illustrated in FIG. 10, the ram includes annular stop members 87 disposed about the respective post assemblies 84.

An inner portion 88 of each of the post assemblies 84 is coupled to a lower ram plate 90, the latter being coupled to a conventional solenoid unit 92. In practice, the solenoid unit 92 is selectively operated so as to rapidly pull the lower ram 90 downwardly; this effects corresponding downward movement of the ram 78 through the post assemblies 84, so as to engage the die set 80 and die cut the workpiece 82.

A total of four impact micrometers of the type illustrated in FIGS. 1–5 are used with the press 74; as shown, an individual impact micrometer 20 is telescoped over each of the post assemblies 84 and rests upon bolster 76, that is the assemblies 84 extend through the passageway 28 of the devices 20.

Prior to operation of the press 74, the respective impact micrometers 20 are adjusted as described above so as to obtain a precise height required. It will be appreciated that this height in effect defines the downward stroke of the ram 78, inasmuch as the underside of each of the stop members 87 is oriented to engage the loading surface 42 of the respective impact micrometers 20 upon each downward stroke of the ram 78.

Once the micrometers 20 are properly adjusted, the operation of press 74 is carried out in the usual manner. During each downward stroke of the ram 78, the stop members 87 engage the surfaces 42 of the micrometers 20, the latter serving to absorb the impact loads. As described previously, the magnitude of such loads actually transmitted to the delicate micrometer threading 36, 62 is minimized owing to the unique construction of the micrometers 20. Thus, the rather substantial and repeated impact loads developed during the downward strokes of the ram 78 are effectively absorbed without damage to the micrometers 20.

I claim:

1. Adjustable load-bearing apparatus, comprising:

first and second interfitted bodies cooperatively defining an enclosed, constant volume internal chamber filled with a substantially incompressible fluid, said first body presenting a loading surface oriented for receiving an externally applied load during use of the apparatus, and an internal load transmitting surface in contact with said fluid, said second body presenting a load-bearing surface area in contact with said fluid; and a shiftable adjuster connected to one of said first and said second bodies in order to cause relative movement of at least one of the bodies relative to the other body, the connection between said adjuster and said one of said first and second bodies being located spaced from and out of contact with said fluid, said adjuster including an element movable within said chamber in response to shifting of the adjuster, said element presenting a load-transmitting surface area in contact with said fluid which transmits load through the element to the connection between said adjuster and said one of said first and second bodies, said element load-transmitting surface area being less than said load-bearing surface area, the connection between said adjuster and said one of said first and second bodies experiencing only a portion of an externally applied load received by said loading surface.

2. The apparatus of claim 1, said adjuster including a rotatable member threadably coupled to said first body, said element coupled with said rotatable member for movement therewith.

3. The apparatus of claim 2, said rotatable member having a first scale thereon, said second body having a second scale thereon, said first and second scales being correlated to measure the relative movement of said first and second bodies upon rotation of the rotatable member.

4. The apparatus of claim 1, said first body being movable relative to said second body.

5. The apparatus of claim 1, said first and second bodies and said chamber each being of annular configuration.

6. The apparatus of claim 1, said first body being of cylindrical configuration, said second body being cup-shaped to receive said first body, and said chamber being cylindrical.

7. The apparatus of claim 1, said apparatus having a load reduction factor of at least 8.

8. A die cutting press comprising:

a rigid bolster;

a ram;

a die set between said ram and bolster and carrying a cutting die, said die set operable to receive therein a workpiece to be die cut;

a plurality of posts operatively coupling said ram and bolster for selective movement of the ram in order to actuate said die set and die cut said workpiece;

a plurality of impact micrometers respectively operatively located adjacent said posts and defining stops for limiting the stroke length of the ram, each of said impact micrometers comprising— first and second interfitted bodies cooperatively defining an enclosed, constant volume internal chamber filled with a substantially incompressible fluid, said first body presenting a loading surface oriented for receiving an externally applied load during use of the apparatus, and an internal load transmitting surface in contact with said fluid, said second body presenting a load-bearing surface area in contact with said fluid; and a shiftable adjuster connected to one of said first and said second bodies in order to cause relative movement of at least one of the bodies relative to the other body, the connection between said adjuster and said one of said first and second bodies being located spaced from and out of contact with said fluid, said adjuster including an element movable within said chamber in response to shifting of the adjuster, said element presenting a load-transmitting surface area in contact with said fluid which transmits load through the element to the connection between said adjuster and said one of said first and second bodies, said element load-transmitting surface area being less than said load-bearing surface area, the connection between said adjuster and said one of said first and second bodies experiencing only a portion of an externally applied load received by said loading surface.

9. The die press of claim 8, each of said impact micrometers being of annular configuration and disposed about a respective post.

10. The die press of claim 8, said adjuster including a rotatable member threadably coupled to said first body, said element coupled with said rotatable member for movement therewith.

11. The die press of claim 10, said rotatable member having a first scale thereon, said second body having a second scale thereon, said first and second scales being correlated to measure the relative movement of said first and second bodies upon rotation of the rotatable member.

12. The die press of claim 8, said first body being movable relative to said second body.

13. The die press of claim 8, said element load-transmitting surface area being at least about eight times less than said load-bearing surface area.

14. The die press of claim 8, said second body being of cupped configuration, said first body being in the shape of a pin.

* * * * *